US005470268A

United States Patent [19]

Dasa

[11] Patent Number: 5,470,268

[45] **Date of Patent: * Nov. 28, 1995**

[54] MODEL AIRPLANE OR TOY GLIDER

[76] Inventor: Madhava Dasa, P.O. Box 461, Kula, Hi. 96790-0461

[ * ] Notice: The portion of the term of this patent subsequent to Aug. 28, 2010, has been disclaimed.

[21] Appl. No.: 583,094

[22] Filed: Sep. 17, 1990

Related U.S. Application Data

[62] Division of Ser. No. 179,231, Apr. 8, 1988, Pat. No. 4,957, 465.

[51] Int. Cl.[6] ..... A63H 27/01; A63H 27/18

[52] U.S. Cl. ..... 446/67

[58] Field of Search ..... 446/61, 63, 64, 446/66–68, 488

[56] References Cited

U.S. PATENT DOCUMENTS

| | | | |
|---|---|---|---|
| 2,867,941 | 1/1959 | Du Breuil | 446/67 |
| 3,714,734 | 2/1973 | Livingston | 446/67 |
| 3,733,737 | 5/1973 | Goodman | 446/68 |
| 4,119,283 | 10/1978 | De Yarman | 446/61 X |

*Primary Examiner*—Mickey Yu

[57] ABSTRACT

A series of model airplane or toy glider complex three dimensional fuselage constructed of semi-rigid scoreable and foldable material such as sheet polystyrene foam mated to wing via elastic band. Varieties may include gliders resembling natural creatures.

10 Claims, 2 Drawing Sheets

MODEL AIRPLANE OR TOY GLIDER

This is a division of application Ser. No. 07/179,231, filed Apr. 8, 1988, now U.S. Pat. No. 4,957,465, granted Sep. 18, 1990.

BACKGROUND OF THE INVENTION

This invention relates to model airplanes and toy gliders which have motion imparted to them by a user's hand or by any device capable of imparting motion.

SUMMARY OF THE INVENTION

A primary object of this invention is to provide a realistically and accurately shaped three dimentional whole body fuselage for a model airplane or toy glider resembling a natural creature or of other design which may be screen printed on flat material, die cut and scored, and then folded and incorporated into a finished model airplane or toy glider. This and other objects of the invention will become more apparent in the following description of the preferred embodiments.

DETAILED DESCRIPTION OF THE PREFERRED EMBODIMENTS

A First Embodiment

Figure 1:
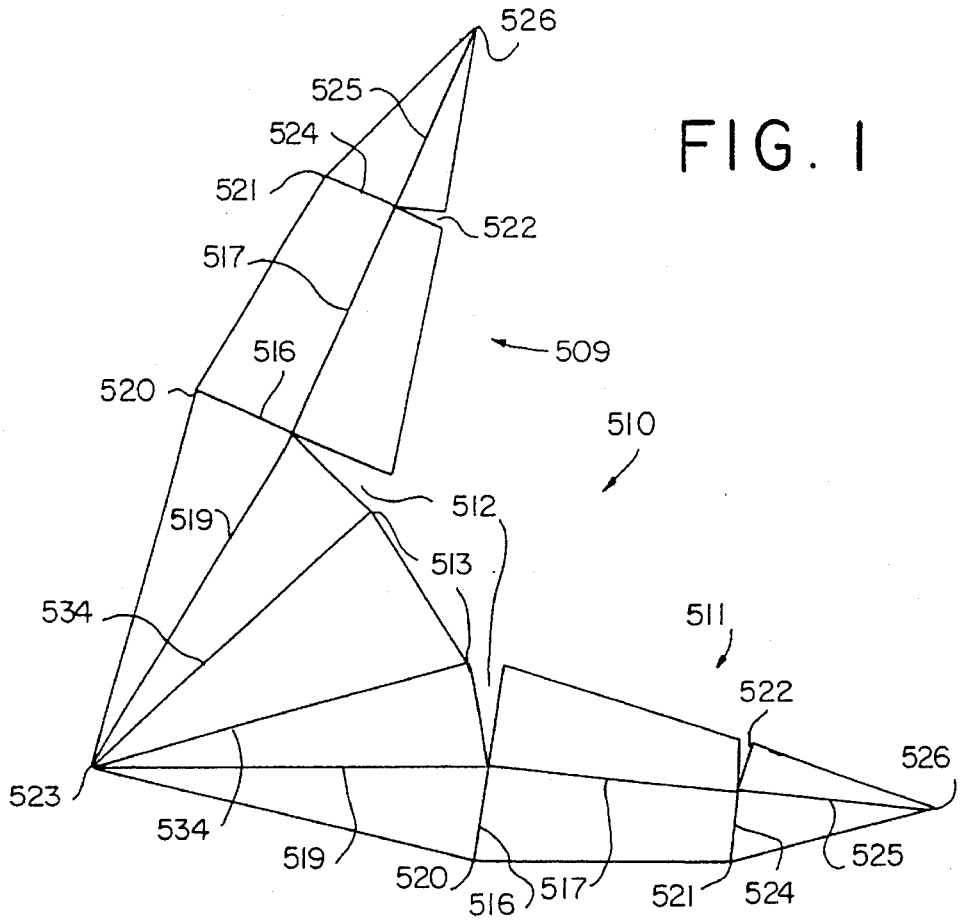
FIG. 1 is a plan view of a complex three dimensional fuselage in unfolded condition.

Referring to FIG. 1, a complex three dimensional fuselage 510 constructed of semi-rigid material such as polystyrene foam sheet is pictured unfolded, is symetrical, is generally V-shaped and has two generally symetrical left and right half portions 509 and 511 respectively. Each half 509 and 511 has a V-shaped indentation 512. Scores 516, 517 and 519 extend from the apex of V-shaped indentation 512. Scores 517, 524 and 525 extend from the apex of V-shaped cut 522. Score 516 extends to point 520, score 517 extends from the apex of V-shaped cut 512 to the apex of V-shaped cut 522 and score 519 extends to point 523. Score 524 extends to point 521 and score 525 to point 526. Score 534 extends from point 513 to point 523.

All scores are folded downward as viewed, V-shaped indentations 512 and 522 are closed and held together by tape or by other suitable means and a nose weight such as modeling clay is inserted inside the nose section of folded fuselage 510. The completion of the installation of folded fuselage 510 is similar to the completion of the installation of folded fuselage 610 illustrated in FIG. 4.

A Second Embodiment

Figure 2:
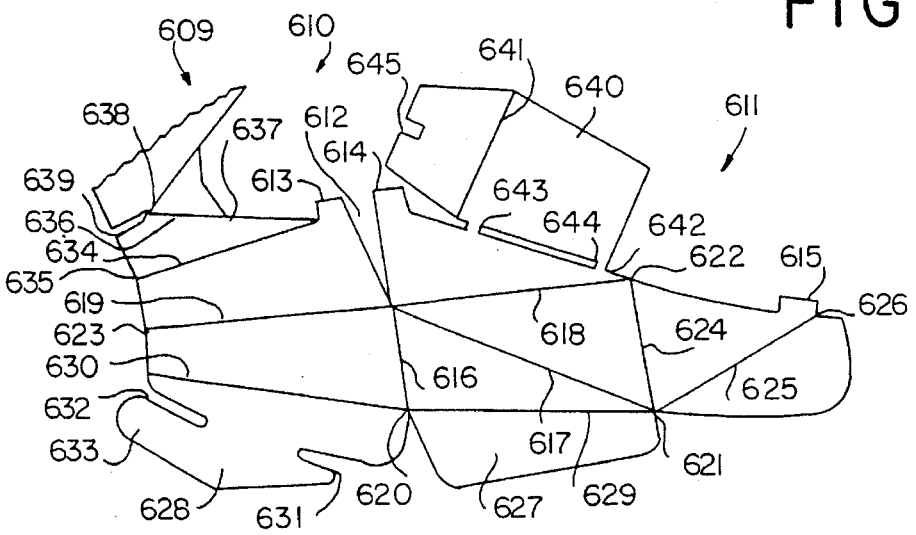
FIG. 2 is a fragmentary plan view of an alternate complex three dimensional fuselage in unfolded condition.

Referring to FIG. 2, a complex three dimensional fuselage 610 constructed of semi-rigid scoreable and foldable material such as polystyrene foam sheet is pictured unfolded, is symetrical, is generally V-shaped and has two generally symetrical left and right half portions 609 and 611 respectively. Only the right half portion 611 is fully depicted.

Each generally symetrical left and right half portion 609 and 611 respectively, has a V-shaped cut or indentation 612 and tabs 613, 614 and 615. Scores 616–619 extend from the apex of V-shaped cut 612. Score 616 extends to point 620, score 617 to point 621, score 618 to point 622 and score 619 to point 623. Score 624 extends from point 621 to point 622. Score 625 extends from point 621 to point 626. Tabs 627 and 628 are formed by scores 629 and 630 respectively. Tab 628 has a notch 631, and a notch 632. Notch 632 creates tab 633. Score 634 extends from the base of tab 613 to point 635. Score 636 extends from point 637 to point 638. Notch 639 is located at the forwardmost position along the longitudinal centerline of fuselage 610 forward of point 638. Discrete internal fuselage rib 640 with score 641 and notch 645 is shown removeably attached to fuselage 610 edge 642 via breakable small tabs 643 and 644.

Internal fuselage rib 640 is separated from the remainder of fuselage 610 by breaking small tabs 643 and 644. All scores are folded downward as viewed except score 625 which is folded in the opposite direction. Tabs 627 and 628 are hard folded up into the interior of the now roughly cylindrically folded fuselage 610 (see FIG. 4). Discrete internal rib 640 is placed in horizontal position and forward notch 645 is inserted into notches 631 on now internal tabs 628 thereby loosely holding together the middle portion of folded fuselage 610.

Figure 4:
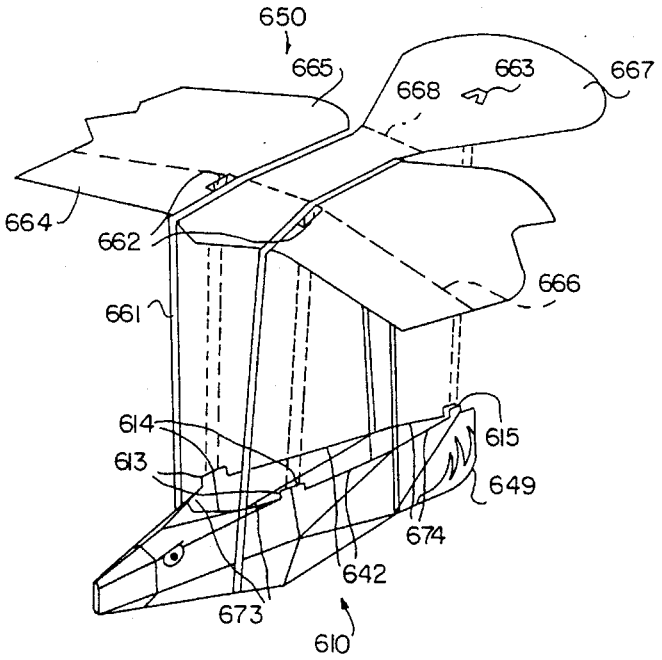
FIG. 4 is a partially exploded fragmentary perspective view of a model airplane or toy glider incorporating the fuselage of FIG. 2 and other aspects of the present invention, including assemblage via elastic band.

A nose weight cap, not shown, such as a rubber pencil cap eraser is inserted into the now hexigonal front opening of folded fuselage 610 and over internal tabs 633 thus holding together the front end portion of folded fuselage 610. The completion of the installation of folded fuselage 610 is illustrated in FIG. 4.

A Third Embodiment

Figure 3:
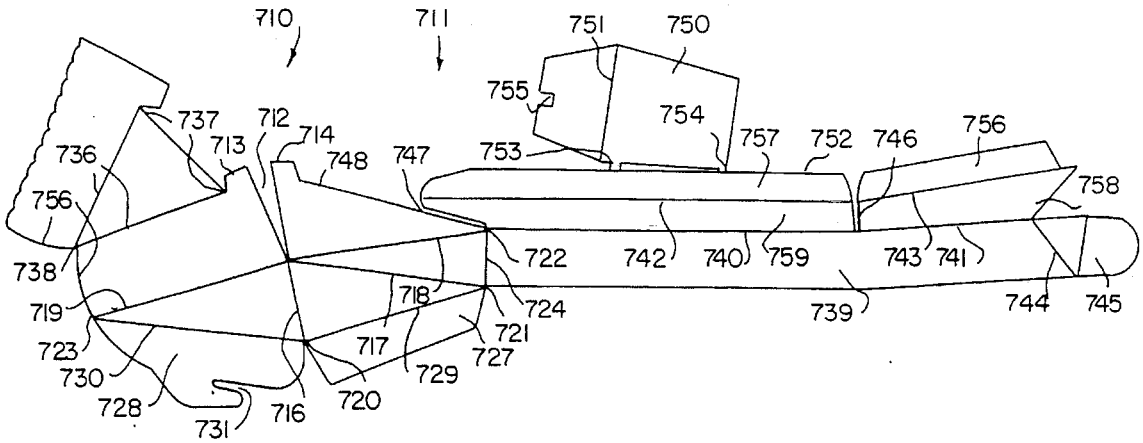
FIG. 3 is a fragmentary plan view of another alternate complex three dimensional fuselage in unfolded condition.

Referring to FIG. 3, an alternate complex three dimentional fuselage 710 for a dragonfly model airplane or toy glider is similar to the fuselage illustrated in FIG. 2. Half 711 has a V shaped cut 712 and tabs 713 and 714. Additional V shaped cuts are not pictured but could be incorporated forward or rearward of V shaped cut 712. Scores 716–719 extend from the apex of V shaped cut 712. Score 716 extends to point 720, score 717 to point 721, score 718 to point 722 and score 719 to point 723. Score 724 extends from point 721 to point 722. Tabs 727 and 728 are formed by scores 729 and 730 respectively. Tab 728 has a notch 731. Score 736 extends from point 737 to longitudinal centerline forwardmost point 738.

Half 711 has an elongated rearwardly extending portion 739. Rearwardly extending portion 739 has scores 740, 745 and cut 746. Cut 747 is located along edge 748. Discrete internal fuselage rib 750 with score 751 and notch 755 is shown removeably attached to fuselage 710 edge 752 via breakable small tabs 753 and 754.

Internal fuselage rib 750 is separated from the remainder of fuselage 710 by breaking small tabs 753 and 754. All scores are folded downward as viewed except scores 724 and 745 which are folded in the opposite direction. Tabs 727 and 728 are hard folded up into the interior of the now roughly cylindrically folded fuselage 710. Discrete internal rib 750 is placed in horizontal position and forward notch 755 is inserted into notches 731 on now internal tabs 728 thereby loosely holding together the middle portion of folded fuselage 710.

Rearward tabs 756 and 757 are folded down into the interior of rearwardly extending portion 739. A small elastic band, not shown, is placed around the fuselage portion extending rearward from cut 746 thus firmly holding tabs 756 down into the interior of folded fuselage 710 and fixing a generally triangular cross sectional shape to the rearwardly extending portion 739. Tabs 758 and 759 form the horizontal top surface of the now generally triangular rearwardly extending portion 739 of fuselage 710. A nose weight, not shown, in the form of large dragonfly eyes is attached by suitable means to the forward portion of fuselage 710. The completion of the installation of folded fuselage 710 is similar to the completion of the installation of folded fuselage 610 illustrated in FIG. 4.

A Fourth Embodiment

Referring to FIG. 4, the model airplane or toy glider complex three dimentional fuselage 610 of FIG. 2, now folded, is to be mated with wing 650 via elastic band 661. Elastic band 661 is pictorially shown greatly expanded. Fuselage tabs 613 and 614 insert into slots 662. Tabs 615 insert into slot 663.

Wing leading edge panel 664 is bent down relative to trailing edge panel 665 along lateral score 666, rearward panel 667 is bent up along score 668. Fuselage 610 has edges 642, 673 and 674, the horizontal angles of which correspond to the desired horizontal angles of wing leading edge panel 664, wing trailing edge panel 665 and rearward panel 667 respectively. Fuselage panels 649, one visible, are moveable "talon" rudders.

It is understood that the described preferred embodiments are merely illustrative of some of the many specific embodiments which represent applications and principals of the present invention. Clearly, numerous and varied other arrangements may be devised by those skilled in the art without departing from the spirit and scope of the invention.

I claim:

1. A model airplane or toy glider having a wing adapted to be assembled with a complex three dimensional folded fuselage constructed of of semi-rigid scoreable and foldable material, said fuselage having generally symmetrical left and right half portions joined along less than the length of said fuselage, said fuselage in unassembled unfolded condition being generally V-shaped, said folded fuselage being attached to said wing via elastic band.

2. The model airplane or toy glider of claim 1 wherein said fuselage is adapted to accept a weight at the front end of said fuselage.

3. The model airplane or toy glider of claim 1 wherein said wing includes slots located transversely equidistant from the longitudinal centerline of said wing.

4. The model airplane or toy glider of claim 3 wherein said wing further includes a slot located along said longitudinal centerline of said wing.

5. The model airplane or toy glider of claim 1 wherein said wing is constructed of semi-rigid scoreable and foldable material having a score line extending transversely across the length of said wing at approximately one third the distance from a leading edge, dividing said wing into leading edge and trailing edge panels; said leading edge panel in assembled relationship of said model airplane or toy glider, being angled downwardly relative to said trailing edge panel.

6. The model airplane or toy glider of claim 1 wherein said wing further includes a panel extending from the trailing edge of said wing, said panel being generally symmetric about the longitudinal centerline of said wing.

7. The model airplane or toy glider of claim 1 wherein said unfolded fuselage includes a large scored tab connected to the outboard forward edges of said unfolded fuselage, said scored tabs being notched in their forward portion to receive, when in assembled relationship, a nose weight, said scored tabs further being notched in their rearward portion, said complex three dimensional fuselage further having a discrete internal rib part adapted to be inserted into, in assembled relationship, said notch in said rearward portions of said scored tabs thereby providing resistance to compression of said three dimensional folded fuselage due to finger gripping during the time of hand launching.

8. The model airplane or toy glider of claim 1 wherein said elastic band holds said folded fuselage to said wing by wraping transversly around said folded fuselage and longitudinally across said wing.

9. The model airplane or toy glider of claim 1 wherein each of said generally symetrical left and right half portions of said fuselage contains at least one score line.

10. The model airplane or toy glider of claim 1 wherein each of said generally symetrical left and right half portions of said fuselage includes at least one V-shaped indentation, the wide part of said V-shaped indentation being located along an inboard edge of each of said generally symetrical left and right half portions of said fuselage, the apex of said V-shaped indentation extending to a point approximately one half the distance from the inboard edge to an outboard edge of each of said generally symetrical left and right half portions of said fuselage.

* * * * *